US008052403B1

(12) United States Patent
Becher

(10) Patent No.: US 8,052,403 B1
(45) Date of Patent: Nov. 8, 2011

(54) PERISTALTIC PUMP

(76) Inventor: James J. Becher, Cape Coral, FL (US)

( * ) Notice: Subject to any disclaimer, the term of this patent is extended or adjusted under 35 U.S.C. 154(b) by 455 days.

(21) Appl. No.: 11/891,162

(22) Filed: Aug. 9, 2007

(51) Int. Cl.
*F04B 45/08* (2006.01)

(52) U.S. Cl. ..... 417/477.13

(58) Field of Classification Search ..... 417/477.1, 417/477.2, 477.3, 477.4, 477.5, 477.6, 477.7, 417/477.8, 477.9, 477.11, 477.12, 477.13
See application file for complete search history.

(56) References Cited

U.S. PATENT DOCUMENTS

| | | | | |
|---|---|---|---|---|
| 2,406,485 | A * | 8/1946 | Arnold | 417/477.13 |
| 3,172,367 | A * | 3/1965 | Kling | 417/475 |
| 4,231,725 | A * | 11/1980 | Hogan | 417/477.11 |
| 4,256,442 | A * | 3/1981 | Lamadrid et al. | 417/477.11 |
| 4,906,168 | A * | 3/1990 | Thompson | 417/477.1 |
| 5,041,096 | A * | 8/1991 | Beuchat et al. | 604/118 |
| 2004/0213684 | A1* | 10/2004 | Klein | 417/374 |
| 2007/0258838 | A1* | 11/2007 | Drake et al. | 417/477.11 |

FOREIGN PATENT DOCUMENTS

| | | | |
|---|---|---|---|
| SU | 1753039 | A1 * | 8/1992 |
| WO | WO 9412427 | A1 * | 6/1994 |

* cited by examiner

*Primary Examiner* — Devon C Kramer
*Assistant Examiner* — Nathan Zollinger
(74) *Attorney, Agent, or Firm* — William E. Noonan

(57) ABSTRACT

A peristaltic pump includes a support section and a rotor mounted for rotation on the support section. There are a pair of spaced apart cam elements attached to and extending from the rotor. A drive mechanism rotatably operates the rotor such that the cam elements are turned together with the rotor. There are first and second mounting sheaves connected to the support section. Each mounting sheave has a groove formed peripherally therein. An elongate, resilient tube conducts liquid therethrough. The tube includes leading and trailing tube segments and an intermediate tube segment formed longitudinally therebetween. The leading segment is retainably inserted in the groove of the first sheave and the trailing segment is retainably inserted in the groove of the second sheave to hold the intermediate segment of the tube for being operatively engaged by the cam elements as the rotor is operated. This causes liquid to be pumped peristaltically through the intermediate segment of the tube from the trailing segment to the leading segment.

18 Claims, 5 Drawing Sheets

PERISTALTIC PUMP

FIELD OF THE INVENTION

This invention relates to an improved peristaltic pump and, in particular, to a peristaltic pump utilizing a resiliently flexible fluid conducting tube that is releasably attached to a pair of "quick connect" mounting sheaves.

BACKGROUND OF THE INVENTION

Low volume peristaltic pumps are currently utilized in a wide variety of industrial applications (e.g. water treatment, mining, chemical processing) where abrasive, corrosive and/or viscous liquids must be pumped. Such pumps employ the principal of peristalsis to deliver the fluid through a flexible tube or hose. Peristaltic pumps have no valves or seals and the pump fluid contacts only the interior of the tube. As a result, the pump is fairly easy to clean and sterilize. Even caustic and/or abrasive fluids exert little wear and tear on the pump parts so that maintenance is simplified considerably. By the same token, the gentle pumping action exhibited by the peristaltic pump causes little, if any, damage to the tube, particularly when compared to the wear and deterioration typically experienced by components of other types of pumps. Because the pump fluid is contained completely within the tubing, there is little, if any, opportunity for the fluid to be contaminated.

To date, most maintenance required for peristaltic pumps has involved inspecting, cleaning and/or changing the fluid conducting tube. Virtually all low volume peristaltic pumps have utilized a relaxed tube. Such tubing tends to deteriorate after prolonged use and requires periodic replacement. The tube may also require occasional cleaning. In such situations, the tubing must be fully disconnected from the peristaltic pump. Conventionally, opposing ends of the tubing are attached by clamps or brackets to the frame or body of the pump. Such means of attachment must be painstakingly manipulated opened and/or disconnected before the tubing can be removed. After the tube is inspected, it is cleaned and replaced as needed. In either case, the tubing must be tediously reattached to the pump by the aforesaid clamps or brackets. This tends to be a time consuming, annoying and inconvenient procedure that prolongs the pump's downtime.

SUMMARY OF THE INVENTION

It is therefore an object of the present invention to provide for an improved durable and easy to service peristaltic pump, which utilizes a long-lasting pump tube that requires infrequent maintenance and replacement.

It is a further object of this invention to provide a peristaltic pump that allows the pump tubing to be removed and replaced much more quickly and conveniently than is accomplished in conventional peristaltic pumps so that pump maintenance is facilitated considerably.

It is a further object of this invention to provide a peristaltic pump wherein the pump housing is mounted to the pump without requiring brackets, clamps or other components that are awkward, tedious and time consuming to operate.

It is a further object of this invention to provide a peristaltic pump utilizing a quick connect form of flexible tubing that greatly facilitates pump maintenance.

This invention results from a realization that the maintenance and repair of a low volume peristaltic pump may be facilitated considerably by utilizing a resiliently flexible pump hose or tube that is connected at respective ends to a pair of "quick connect" mounting sheaves. This mounting structure allows the hose to be quickly and conveniently removed from and replaced on the pump as required and without the need for clamps, brackets or the like, which are typically time consuming, tedious and annoying to use.

This invention features a peristaltic pump including a support section and a rotor mounted for rotation on the support section. There are a pair of spaced apart cam elements attached to and extending from the rotor. A drive mechanism rotatably operates the rotor such that the cam elements are turned together with the rotor. There are first and second mounting sheaves connected to the support section. Each mounting sheave has a groove formed peripherally therein. An elongate, resilient tube conducts liquid therethrough. The tube includes leading and trailing tube segments and an intermediate tube segment formed longitudinally therebetween. The leading tube segment is retainably insertable in the groove of the first mounting sheave and the trailing tube segment is retainably insertable in the groove of the second mounting sheave to hold the intermediate segment of the tube for being operatively engaged by the cam elements as the rotor is operated. As a result, liquid is pumped peristaltically through the intermediate segment of the tube from the trailing segment to the leading segment.

In a preferred embodiment, the drive mechanism may include a rotary motor and a reduction device that operatively interconnects the motor and the rotor. The reduction device may include a belt that operatively connects an output of the motor to the rotor. The output may include a toothed pulley and the rotor may include a circumferential series of teeth. The drive belt may include a complementary set of teeth that operatively interengage the tooth pulley and the circumferential teeth on the rotor.

The cam elements may include rollers mounted for axial rotation on the rotor. The cam elements may be positioned generally 180° apart on the rotor. The rollers may extend generally parallel to one another.

A pair of tube retainer elements may be attached to the support section. Each retainer element may be positioned adjacent to a respective mounting sheave for holding the leading and trailing segments of the tube in respective grooves of the sheaves.

The tube may include an elongate stretch tube. The tube may be composed of Norprene™.

DETAILED DESCRIPTION OF PREFERRED EMBODIMENTS

Other objects, features and advantages will occur from the following description of a preferred embodiment and the accompanying drawings, in which.

There is shown in FIGS. 1-6 a low volume peristaltic pump 10 that is designed for pumping liquids in various applications. Pump 10 may be used for a wide variety of industrial uses, such as in the chemical water treatment, mining and other industries. The particular technology, application and/or environment in which pump 10 may be utilized is not a limitation of this invention.

Figure 5:
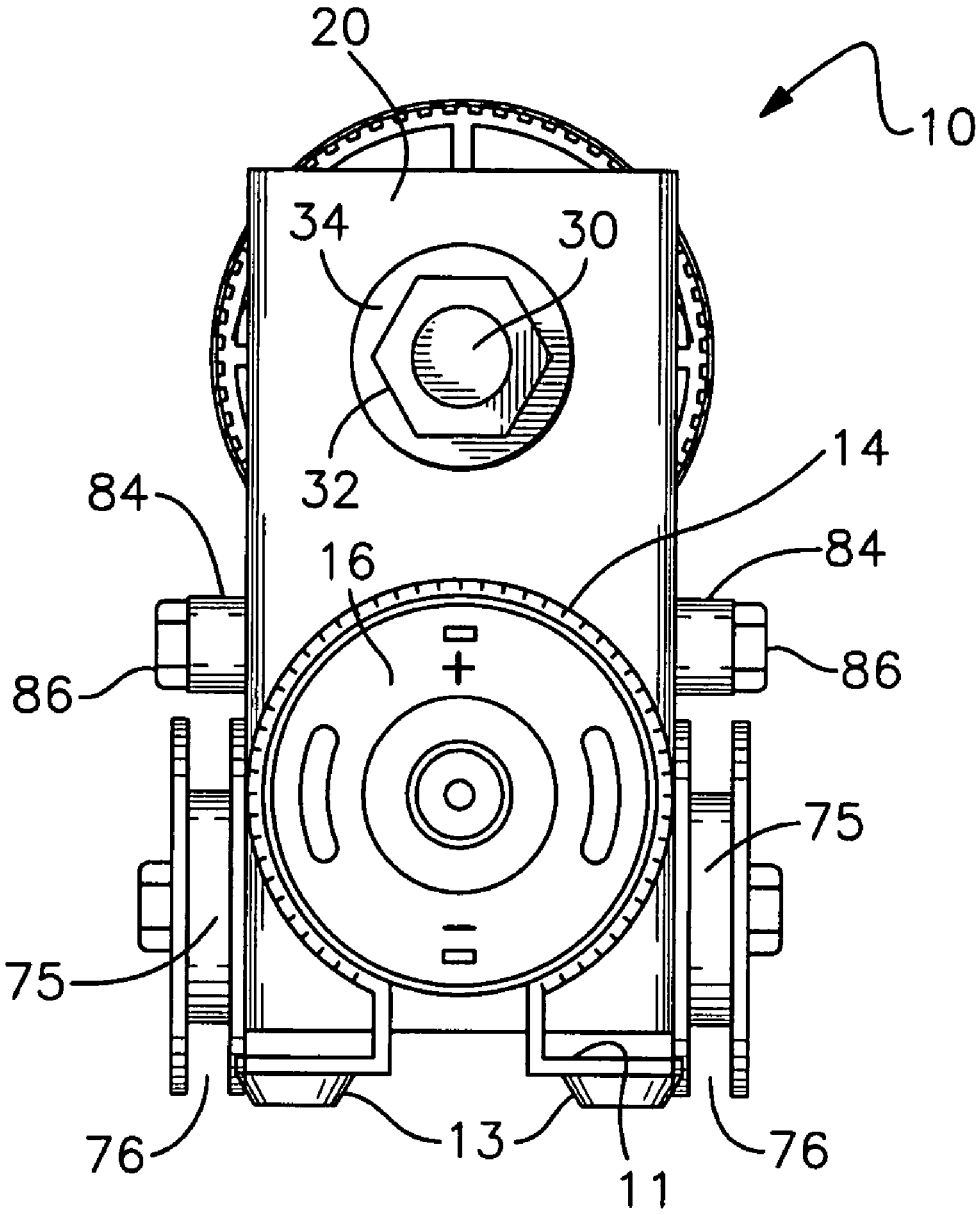
FIG. 5 is a rear elevational view of the peristaltic pump.

Pump 10 employs a base 11, which carries a plurality of rubber of plastic feet 13 for engaging a underlying table or other generally horizontal supportive surface. Feet 13 help to minimize movement of the pump across the supportive surface during operation of the pump. Base 11 is unitarily attached to a cylindrical motor accommodating casing 14, which circumferentially surrounds and receives a rotary motor 16 (FIG. 5). Motor 16 preferably comprises a 12 volt or 24 volt DC motor. The motor may also be adapted in a standard manner for alternating current operation. The size of the motor may be varied to achieve corresponding pumping capacities in a manner that will be understood by persons skilled in the art. Base 11 and casing 14 may be composed of various lightweight yet durable plastics, metals or metal alloys.

A support section 12 abuts an inner end of cylindrical casing 14. Support section 12 comprises a plate-like bracket having a generally vertical wall 20 and a pair of opposing flanges 22 formed along respective vertical edges thereof. A pair of screws 21 (FIGS. 3 and 4) interengage wall 20 and adjoining motor 16 (FIG. 5). This holds support section 12 upright. The flanges 22 widen proximate the lower ends thereof and form parallel side walls 24. Preferably, support section 20 comprises a one-piece construction and is composed of aluminum or some other durable plastic, metal or metal alloy material. As used herein, the "support section" should be construed broadly to include any and all structure used to support the rotor for axial rotation. In alternative embodiments, support section 12 may be attached directly to base 11 and/or motor casing 14.

A plastic rotor 26 is axially rotatably mounted to wall 20 of support section 12. In particular, rotor 26 is mounted on a pivot 28, which may comprise a bolt, bushing, rivet or other comparable structure for axially rotatably mounting rotor 26 to support section 12. For example as depicted in FIGS. 1-5, pivot 28 may comprise a bolt 30 that extends through aligned holes in rotor 26 and wall 20. Bolt 30 is secured to wall 20 by a nut 32, FIG. 5, and a washer 34. The rotor thereby rotates axially freely about bolt 30.

Rotor 26 includes a series of axial teeth 27 that are formed circumferentially about the rotor. This facilitates operation (turning) of the rotor in the manner described more fully below. Rotor 26 also carries a webbing 36 on the side of the rotor facing away from wall 20. Webbing 36 includes four receptacles 38 that are spaced 90° apart from one another on rotor 26. Each receptacle 38 includes a threaded interior circumference. This enables a pair of selected receptacles 38 to be engaged by respective cam rollers 40. FIGS. 1-4 and 6 particularly depict a pair of cam roller components that are axially rotatably attached to and extend from rotor 26. Each roller 40 includes an interior hex screw that is threadably interengaged with a respective receptacle 38. The two cam rollers 40 are attached to a pair of receptacles 38 that are spaced 180° apart on rotor 26 such that the cam rollers 40 are likewise positioned 180° apart. Each cam roller element includes an outer cylindrical roller 42, which is axially rotatably mounted on a respective hex bolt 39 of the cam roller component. As a result, exterior rollers 42 rotate about the respective hex bolts which are in turn secured to respective receptacles 38 of rotor 26.

A drive mechanism 50 is employed for operatively turning rotor 26. The drive mechanism comprises the previously described DC motor 16, which is mounted in cylindrical casing 14, and a reduction mechanism 51 for operatively interconnecting the motor to the rotor. More particularly, the motor includes an output shaft 52 that extends through a lower hole (not shown) in wall 20 of support section 22. Rotary output shaft 52 carries a toothed pulley 54, which is analogous to rotary, motor driven pulleys utilized in conventional peristaltic pumps.

Pulley 54 and rotor 26 are operably interconnected by a drive belt 60. The drive belt is preferably composed of a flexible rubberized or elastomeric material and includes a series of teeth on the inner surface 62 thereof. These teeth cooperate with the teeth of pulley 54 and the peripheral teeth 27 of rotor 26. As a result, when pulley 54 is driven rotatably in a clockwise direction, for example, rotor 26 is similarly driven by the reduction mechanism comprising pulley 54 and belt 60 in the clockwise direction as indicated by arrows 66 in FIGS. 1, 3, 4 and 6.

Figure 1:
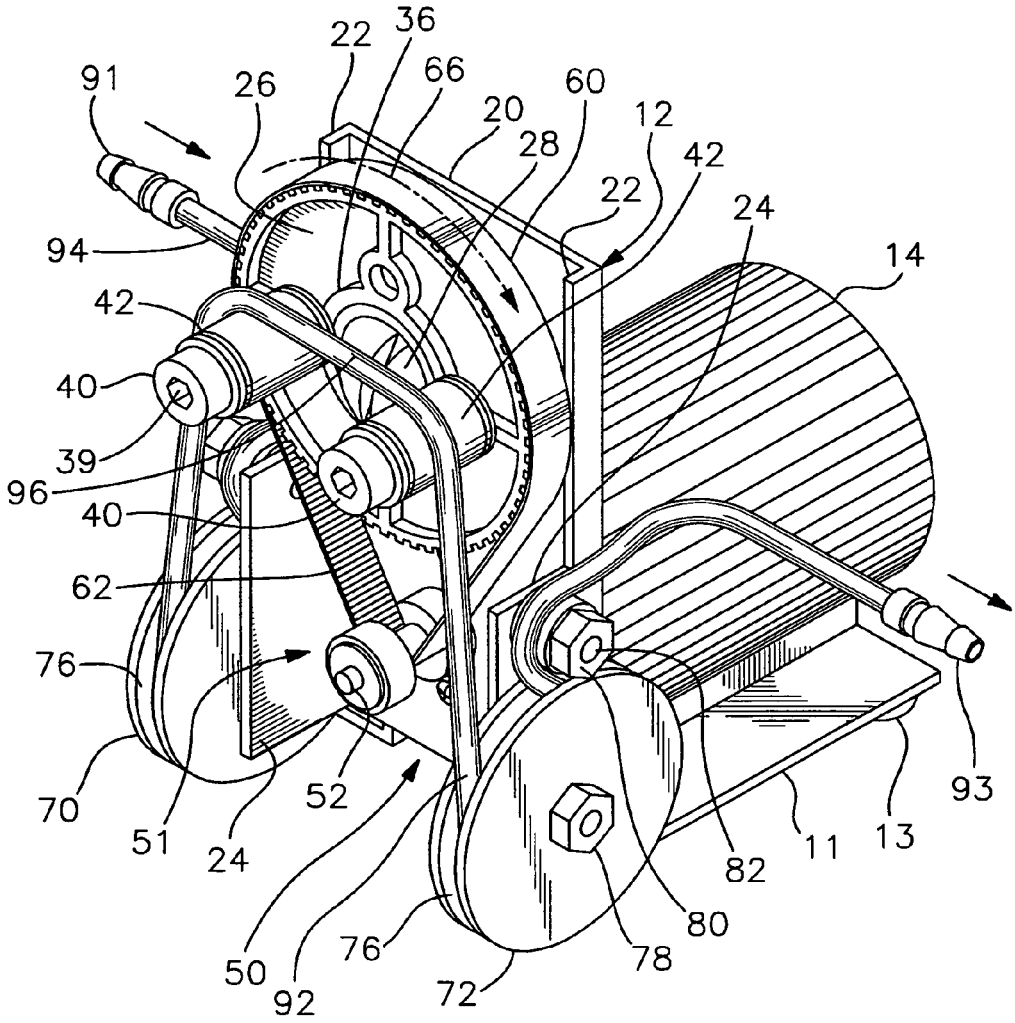
FIG. 1 is a perspective view of a low volume peristaltic pump according to this invention.
Figure 2:
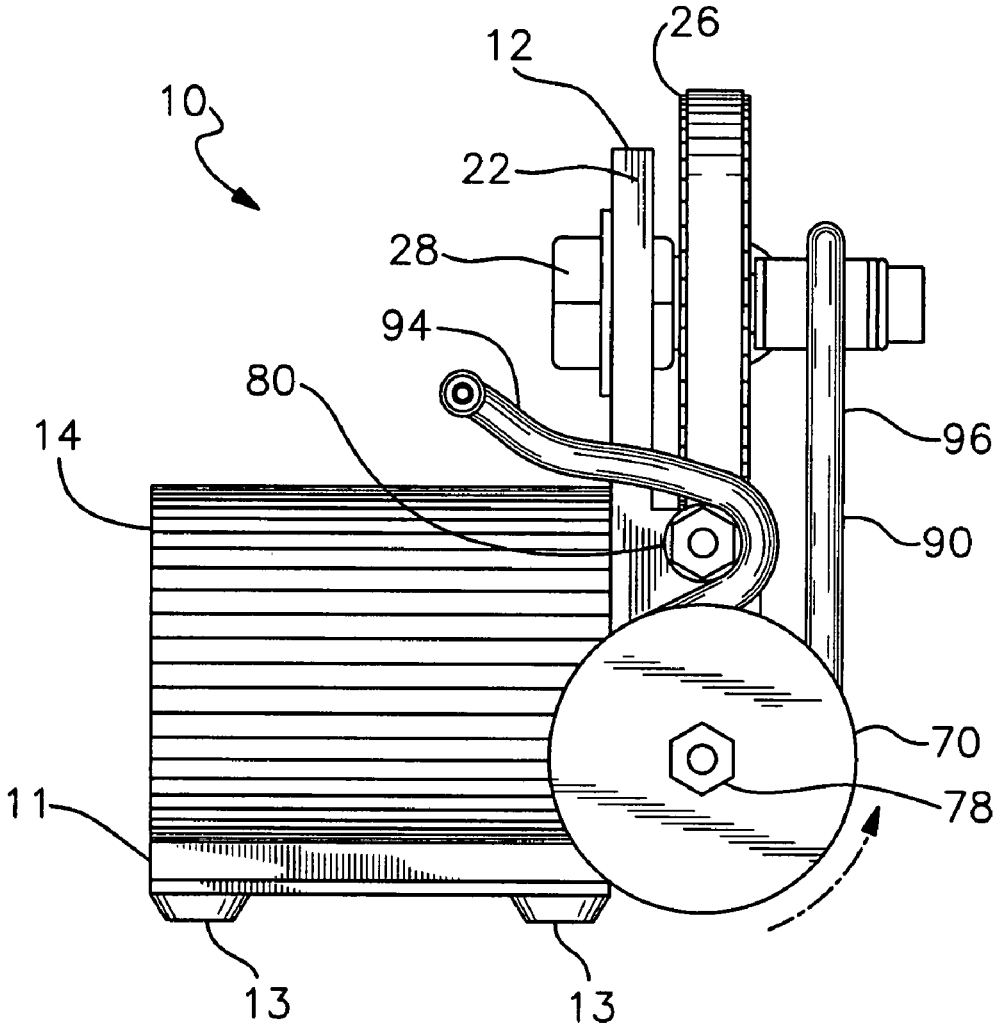
FIG. 2 is a side elevational view of the peristaltic pump.
Figure 4:
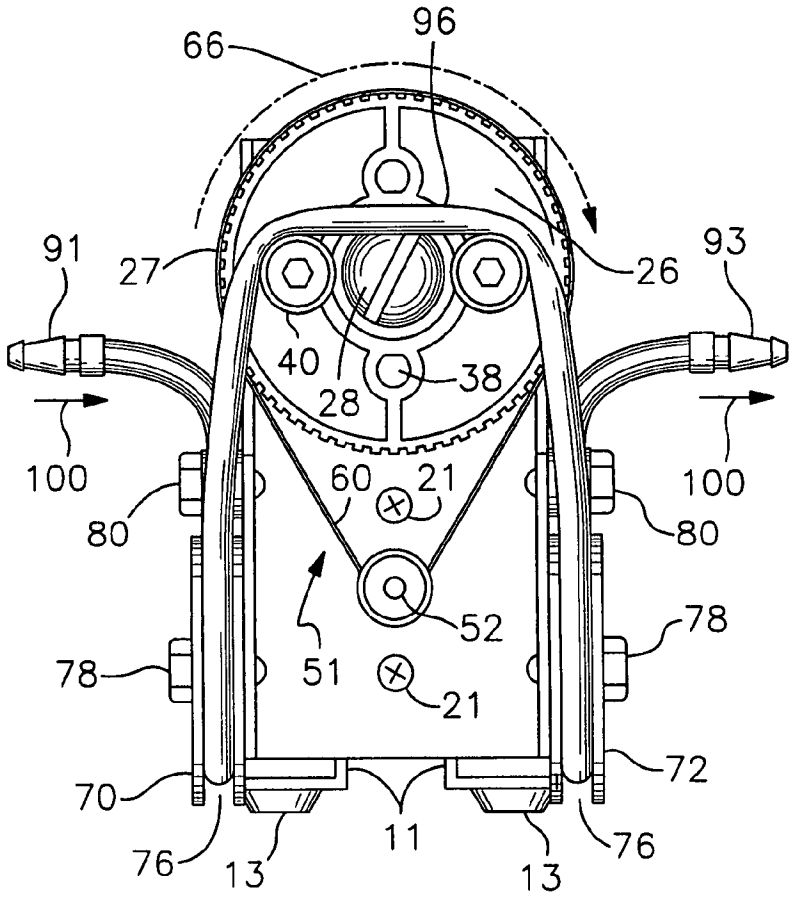
FIGS. 3 and 4 are front elevational views of the pump depicting sequential rotation of the rotor and corresponding operation of the pump such that fluid is moved through the resilient tubing.
Figure 3:
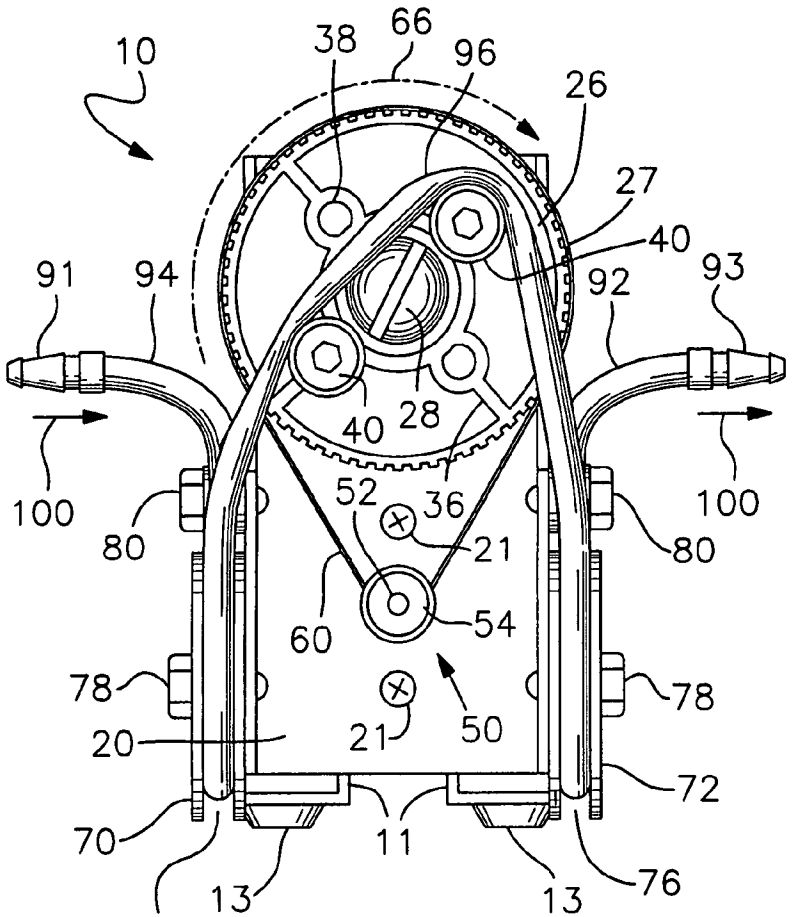

A pair of first and second mounting sheaves 70 and 72 are attached to respective side walls 24 of support section 12. Each sheave is preferably composed of a high-strength, durable plastic and features a generally circular, disk-like shape with a groove 76 formed circumferentially therein. Each groove 76 surrounds a circular hub 75, shown in FIG. 5. The groove is designed for receiving the hose or tube of the pump in a manner described more fully below. Each sheave 70, 72 is fastened to a respective one of the side walls 24 by a nut/bolt connector 78. As best shown in FIGS. 2-4, the mounting sheaves 70, 72 are supported slightly above the feet 13 of the pump and therefore slightly above the underlying table or supportive surface.

Each side wall 24 also carries a tube retainer element 80, which is secured to the side wall 24 of support section 12 proximate and slightly above a respective one of the mounting sheaves 70, 72. Each retainer element includes a bolt that is engaged with the corresponding hole in side wall 24, a bushing 84 (best shown in FIG. 5), which is disposed about bolt 82 and a fastening nut 86 that is attached to the distal end of the bolt adjacent bushing 84. As is described more fully below, the retaining elements 80 work in cooperation with mounting sheaves 70, 72 to hold the pumping tube securely, yet releasably, in place during operation of the peristaltic pump.

An elongate, resilient peristaltic pumping hose or tube 90 is employed by the pump to conduct liquid therethrough. Tube 90 is composed of a durable and resilient tubing, which is commonly referred to as "stretch tube". This is contrasted with "relaxed" tubing, which is universally utilized in low volume peristaltic pumps of the prior art. Preferably, Norprene™ is utilized for the tubing. This material is extremely resilient and durable. It provides for an extended and relatively maintenance free service life. Inlet and outlet fittings 91 and 93 are attached to the respective ends of tube 90 for attaching the tube to other segments of hose or other types of conduits or containers.

More particularly, tube 90 includes a leading tube segment 92 and a trailing tube segment 94. An intermediate tube segment 96 is formed between leading and trailing segments 92 and 94. Leading tube segment 92 is releasably interengaged with first sheave 70 in the manner best shown in FIGS. 1-4. In particular, segment 92 wraps about sheave 72 and is received by circumferential groove 76 in sheave 72. Tube segment 92 extends through groove 76 and passes between sheave 72 and retainer element 80 before exiting the groove. Similarly, trailing segment 94 of tube 90 wraps about first mounting sheave 70 and extends between that sheave and its respective retainer element 80, in the manner best shown in FIG. 2. The tube then extends through the circumferential groove of sheave 70 and exits the groove in a generally vertical direction. Intermediate segment 96 of tube 90 extends above and across cam rollers 40 in the manner best shown in FIG. 1. Tube 90 extends downwardly from rollers 40 such that leading tube segment 92 engages circumferential groove 76 of mounting sheave 72, whereas trailing tube segment 94 engages the circumferential groove of sheave 70. A snug frictional fit is provided between each resilient tube segment 92, 94 and the circumferential groove 76 of its respective mounting sheave. The mounting sheaves hold the leading and trailing ends of the tube securely in place and the tube is retained in snug interengagement with the sheaves by respective retainer elements 80.

With the tube 90 assembled on pump 10 in the manner shown in FIGS. 1-4, pump 10 is ready to perform low volume peristaltic pumping in the manner illustrated in FIGS. 3 and 4. In particular, the inlet and outlet fittings 91 and 93 are interconnected to appropriate upstream and downstream conduits, containers, etc., which may be varied in accordance with the particular pumping application involved. It should be understood that alternative types of fittings or connections may be utilized in conjunction with tube 90. The particular manner in which the tube attaches to or communicates with other conduits or containers is not a limitation of this invention.

It should be understood that a transparent plastic cover or housing may be attached to support section 12, base 11, casing 14 and/or sheaves 70, 72 for covering the rotor and tube during operation of the pump. Such a cover protects the working components of the pump. The particular structure of the cover and its means for attachment to the pump do not constitute part of the invention however.

Motor 16 is actuated by an appropriate electrical power source to operate drive mechanism 50. In particular, rotary shaft 52 rotates in a clockwise manner to drive belt 60 and rotor 26 in the direction of arrow 66. This turns cam roller components 40 with the rotor, as depicted in FIGS. 3 and 4. Cam rollers 40 engage intermediate section 96 of tube 90 such that peristaltic-type pumping in the direction of arrows 100 is performed in a generally conventional manner. In particular, when pressure is applied by a roller to the tube, the liquid is urged forwardly. By the same token, when roller pressure on the tube is relieved, a vacuum is created, which continues to push liquid forwardly. Liquid is pumped through intermediate tube segment 96 from trailing tube segment 94 to leading tube segment 92. From there, the liquid is pumped to its eventual destination.

Figure 6:
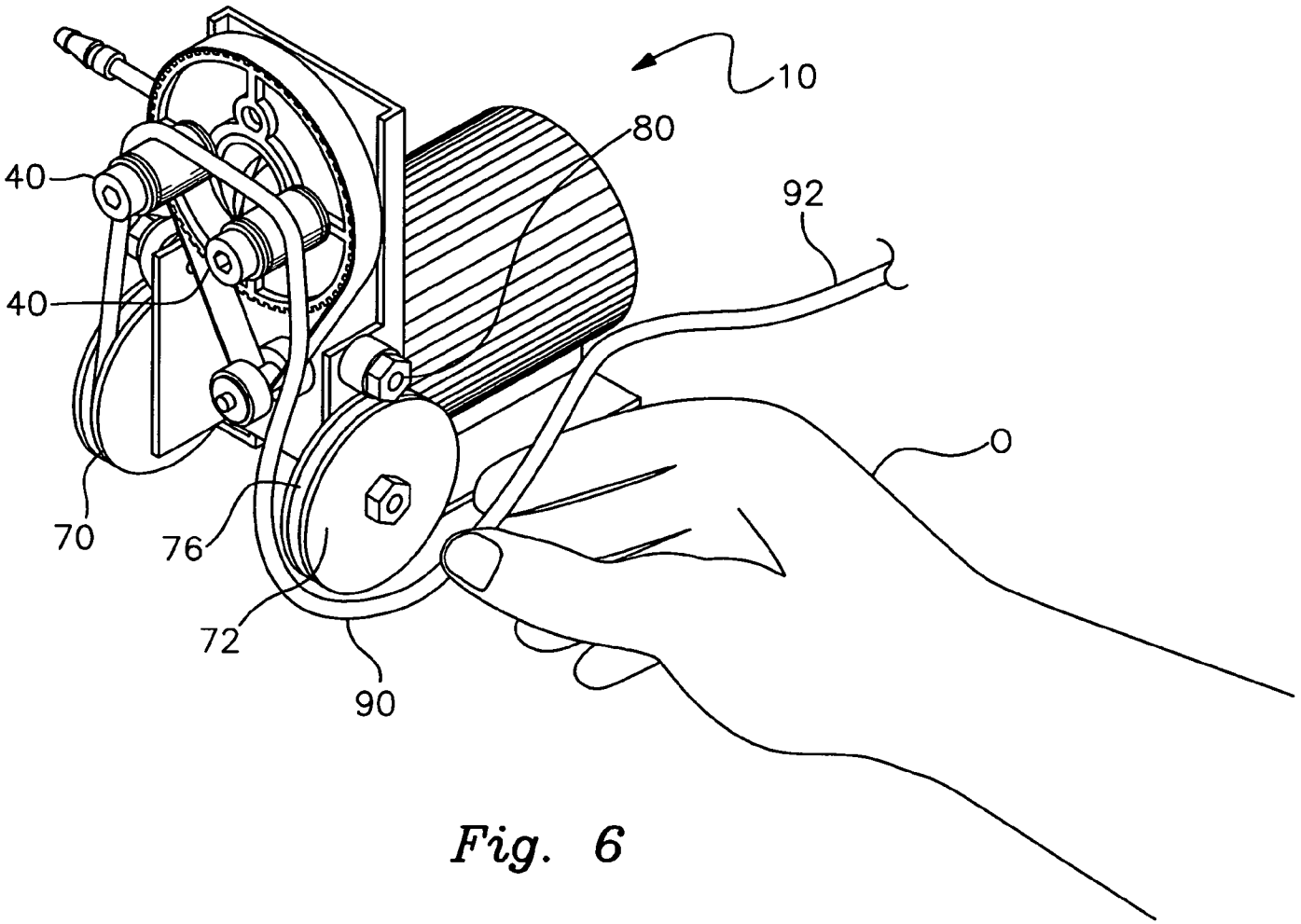
FIG. 6 is a perspective view of the pump with the tube shown in fragmentary fashion and disengaged from the mounting sheaves.

Tube 90 may be installed in and removed from pump 10, as required, in an extremely quick and convenient manner. Initially, as shown in FIG. 6, operator 0 attaches tube 90 at its respective end segments to sheaves 70 and 72 by simply grasping a respective end segment of the tube (e.g. segment 92 in FIG. 6) and wrapping the tube segment about the sheave such that the tube segment is received in circumferential groove 76. The tube segment is then squeezed and inserted between the sheave and its associated retainer element 80 such that it is held securely in place as depicted in FIGS. 1-4. The end of the tube and its attached fitting may then be oriented in any desired direction and attached to a desired conduit or container. Hose 90 may be engaged with (e.g. extended above and across) cam rollers 40 either before or after the leading and trailing tube segments are securely engaged with their respective mounting sheaves 70 and 72.

It is similarly easy to remove hose 90 from the pump when the hose needs to be inspected, cleaned and/or replaced. Operator 0 simply grasps one end of tube 90 and pulls either leading or trailing segment of the tube from between a respective sheave 70, 72 and its associated retainer element 80. The distance between the sheave and the retainer element should be slightly less than the normal diameter of the tube so that the tube is held snugly and securely in place between the sheave and the retainer element. By the same token, the distance between each sheave and its associated retainer element should be wide enough so that the resiliently flexible tube is readily inserted into or removed from between the sheave and retainer element without requiring undue manual force or pressure. The resilient composition of the tube further facilitates such insertion and removal.

Accordingly, the present invention allows for the tubing or hose of a low volume peristaltic pump to be installed in or removed from the pump in a manner that is faster, easier and less annoying than has been heretofore possible in conventional peristaltic pumps. No clamps, clips or brackets must be unfastened and refastened to perform the tube changing operation. Maintenance of the peristaltic pump is therefore simplified and facilitated. By using a quick connect mounting sheave and resilient Norprene™ pumping tube of this invention, an easily serviceable, relatively maintenance free and long-lasting peristaltic pump is provided.

From the foregoing it may be seen that the apparatus of this invention provides for an improved peristaltic pump and, in particular, to a peristaltic pump utilizing a resiliently flexible fluid conducting tube that is releasably attached to a pair of "quick connect" mounting sheaves. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

Other embodiments will occur to those skilled in the art and are within the following claims:

What is claimed is:

1. A peristaltic pump apparatus comprising:

a support section;

a rotor mounted for rotation on said support section;

a pair of spaced apart cam elements attached to and extending from said rotor;

a drive mechanism for rotatably operating said rotor such that said cam elements are turned together with said rotor;

first and second mounting sheaves immovably fastened to said support section, each mounting sheave including a hub and a peripheral groove that surrounds said hub;

an elongate, resilient tube for conducting liquid therethrough, said tube including leading and trailing tube segments and an intermediate tube segment formed longitudinally therebetween, said leading segment being retainably inserted in said groove and wrapped about said hub of said first sheave and said trailing segment being retainably inserted in said groove and wrapped about said hub of said second sheave to hold said intermediate segment of said tube for being operatively engaged by said cam elements as said rotor is operated; and a pair of retainer elements, each said retainer element attached to said support section adjacent to a respective sheave and spaced apart from a peripheral edge of said respective sheave by a distance less than the normal diameter of said tube for holding said leading and trailing segments of said tube in respective said grooves of said sheaves, said intermediate segment of said tube having an exterior surface that is engaged exclusively by said cam elements during operation of said rotor, whereby liquid is pumped peristaltically through said intermediate segment of said tube from said trailing segment to said leading segment.

2. The apparatus of claim 1 in which said drive mechanism includes a rotary motor and a reduction device that operatively interconnects said motor and said rotor.

3. The apparatus of claim 2 in which said reduction device includes a belt that operatively connects an output of said motor to said rotor.

4. The apparatus of claim 3 in which said reduction device further includes a toothed pulley connected to said output of said motor, said rotor includes a circumferential series of teeth and said drive belt includes a lateral set of teeth that operatively interengage said toothed pulley and said circumferential teeth on said rotor.

5. The apparatus of claim 1 in which said cam elements include rollers mounted for axial rotation of said rotor.

6. The apparatus of claim 1 in which said cam elements are positioned generally 180° apart on said rotor.

7. The apparatus of claim 1 in which each said sheave includes a generally circular, disk-like shape with said groove formed circumferentially therein and surrounding said hub, said sheave having a center axis extending through said hub and surrounded by said groove, which center axis is transverse to the axis of rotation of said rotor, each said retainer element including a central axis parallel to said center axis of said adjacent sheave.

8. The apparatus of claim 1 in which said support section includes a plate-like bracket having a generally vertical wall and a pair of parallel side walls that are attached to and extend perpendicularly from respective side edges of said vertical wall, said rotor being mounted for rotation against said vertical wall between said side walls, each sheave being immovably fastened to a respective one of said side walls such that said sheaves are oriented parallel to one another, each said retainer element mounted to and extending outwardly from a respective said side wall.

9. The apparatus of claim 8 in which said drive mechanism includes a rotary motor and said support section includes a base on which said rotary motor is mounted, said base being connected to said bracket such that said sheaves are supported above a bottom of said base.

10. The apparatus of claim 7 in which said center axes of said respective sheaves are aligned.

11. The apparatus of claim 1 in which each said sheave includes a generally circular, disk-like shape having a groove formed circumferentially therein and wherein each retainer element includes an elongate component secured to said support section and having a longitudinal axis that is oriented to be parallel to said center axis of said adjacent sheave.

12. A peristaltic pump apparatus comprising:

a support section including a base and a plate-like bracket attached to and extending upwardly from said base, said bracket including a vertical wall and a pair of parallel side walls attached to and extending transversely from respective edges of said vertical wall;

a rotor mounted for rotation against said vertical wall between said side walls;

a pair of spaced apart cam elements attached to and extending from said rotor;

a drive mechanism for operating said rotor such that said cam elements are turned together with said rotor;

first and second mounting sheaves connected to respective side walls of said support section, each said mounting sheave having a groove formed peripherally therein, said mounting sheaves being oriented such that said peripheral grooves in said respective sheaves are substantially parallel to one another; and an elongate, resilient tube for conducting liquid therethrough, said tube including leading and trailing tube segments and an intermediate tube segment formed longitudinally therebetween, said leading segment being retainably inserted in said groove of said first sheave and said trailing segment being retainably inserted in said groove of said second sheave to hold said intermediate segment of said tube for being operatively engaged by said cam elements as said rotor is operated, whereby liquid is pumped peristaltically through said intermediate segment of said tube from said trailing segment to said leading segment, each said sheave having a hub surrounded by a respective said groove, each said sheave having a center axis extending through said hub and surrounded by said groove, which center axis is transverse to the axis of rotation of said rotor, said apparatus further including a pair of elongate retainer elements, each said retainer element being attached to and extending outwardly from a respective said side wall adjacent to a respective said sheave for holding said leading and trailing segments of said tube in respective grooves of said sheaves, each said retainer element having a longitudinal axis that is generally parallel to the center axis of said adjacent sheave, said central axes of said respective retainer elements being aligned with one another.

13. The apparatus of claim 12 in which each said sheave includes a generally circular, disk-like configuration and wherein said peripheral groove is formed circumferentially in said sheave.

14. The apparatus of claim 12 in which said drive mechanism includes a rotary motor mounted on said base and interconnected through said vertical wall to a reduction device that operatively interconnects said motor and said rotor.

15. The apparatus of claim 12 in which said intermediate segment of said tube has an exterior surface that is engaged exclusively by said cam elements during operation of said rotor.

16. A peristaltic pump apparatus comprising:

a support section;

a rotor mounted for rotation on said support section;

a pair of spaced apart cam elements attached to and extending from said rotor;

a drive mechanism for rotatably operating said rotor such that said cam elements are turned together with said rotor;

first and second mounting sheaves immovably fastened to said support section, each mounting sheave including a hub and a peripheral groove that surrounds said hub, each sheave having a center axis extending through said hub and surrounded by said peripheral groove of said sheave, which center axis extends transversely to the axis of rotation of said rotor;

an elongate, resilient tube for conducting liquid therethrough, said tube including leading and trailing tube segments and an intermediate tube segment formed longitudinally therebetween, said leading segment being retainably inserted in said groove and wrapped about said hub of said first sheave and said trailing segment being retainably inserted in said groove and wrapped about said hub of said second sheave to hold said intermediate segment of said tube for being operatively engaged by said cam elements as said rotor is operated; and a pair of retainer elements, each said retainer element attached to said support section adjacent to a respective sheave and spaced apart from a peripheral edge of said sheave by a distance that is less than the normal diameter of said tube for holding said leading and trailing segments of said tube in respective said grooves of said sheaves, whereby liquid is pumped peristaltically through said intermediate segment of said tube from said trailing segment to said leading segment.

17. The apparatus of claim 16 in which each said retainer element includes a central axis parallel to said center axis of said adjacent sheave, said support section including a plate-like bracket having a generally vertical wall and a pair of parallel side walls that are attached to and extend perpendicularly from respective side edges of said vertical wall, said rotor being mounted for rotation against said vertical wall between said side walls, each sheave being immovably fastened to a respective one of said side walls such that said sheaves are oriented parallel to one another with said center axes aligned with one another, said retainer elements mounted to and extending outwardly from respective said side walls.

18. The apparatus of claim 17 which said intermediate segment of said tube has an exterior surface that is engaged exclusively by said cam elements during operation of said rotor.

* * * * *